United States Patent [19]

Yang

[11] Patent Number: 4,756,173

[45] Date of Patent: Jul. 12, 1988

[54] ZIPPER LOCK

[76] Inventor: Ching S. Yang, No. 8, Lane 194, Lien Cheng Road, Chung Ho City, Taipei Hsien, Taiwan

[21] Appl. No.: 10,391

[22] Filed: Feb. 3, 1987

[51] Int. Cl.[4] ..... E05B 67/38

[52] U.S. Cl. ..... 70/68; 70/71

[58] Field of Search ..... 70/68, 69–76; 24/386, 387, 425, 426

[56] References Cited

U.S. PATENT DOCUMENTS

| | | | |
|---|---|---|---|
| 1,907,778 | 5/1933 | Freysinger | 70/68 |
| 4,343,162 | 8/1982 | Giacometti | 70/71 |
| 4,514,884 | 5/1985 | Kaneko | 70/68 |

*Primary Examiner*—Robert L. Wolfe

*Attorney, Agent, or Firm*—Burgess, Ryan & Wayne

[57] ABSTRACT

A zipper lock disposed on a shift plate of a zipper includes a longitudinal box-shaped casing; a lock stand having a hollow, substantially P shape; a lock ward having a shape substantially of a numeral 7 with one arm thereof forming a recess shoulder; at least one spring for pushing the lock stand and the lock ward against an inside wall of the casing; a cylindrical lock shaft having a retracted shoulder on upper and lower ends thereof and a key slot; a lock pin plate with an extended protusion at one end thereof having a length equal to that of a hollow part of the lock stand; and a seat plate corresponding to a zipper sliding plate and having a knot hole, a lock shaft hole and two recess holes adjacent the lock shaft hole and corresponding to the protrusion on the lock pin plate; the improvement being that the lock stand provides a resisting force against the lock ward so that when the lock stand is moved longitudinally and an extended arm thereof leaves the recess shoulder of the lock ward, the lock ward will spring out from the casing, thus providing the zipper lock in an open position, and when the zipper lock is in a closed position, the lock pin plate can be rotated by a separate key so that its protusion can be moved from one recess hole in the seat plate to another recess hole, thereby making the lock stand unmovable in the longitudinal direction of the zipper lock and thereby providing the lock in a locked position.

3 Claims, 4 Drawing Sheets

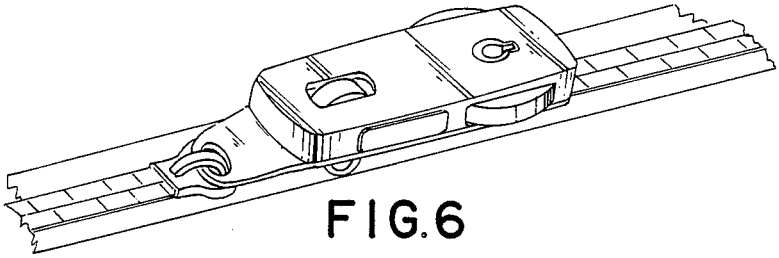
FIG. 6
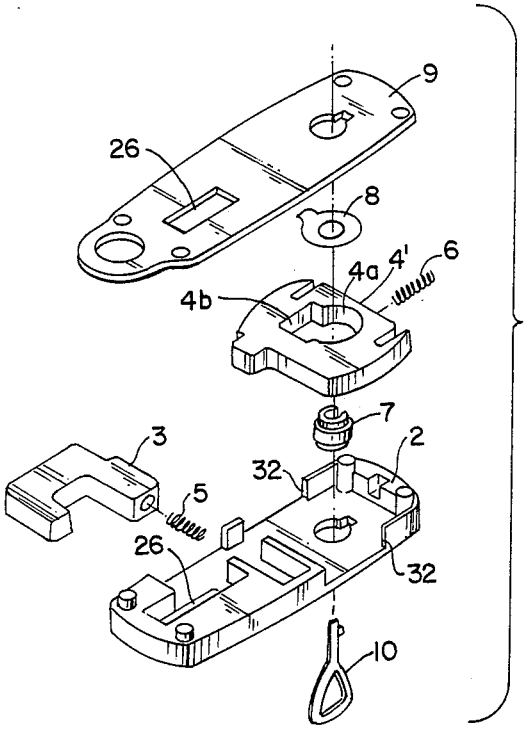
FIG. 7
FIG. 8
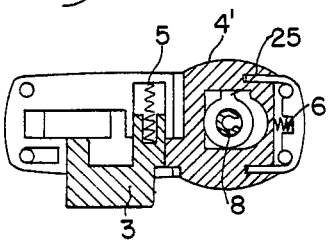
FIG. 9
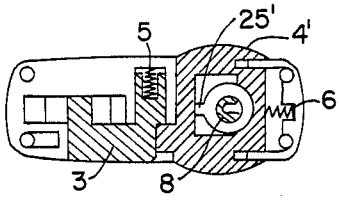

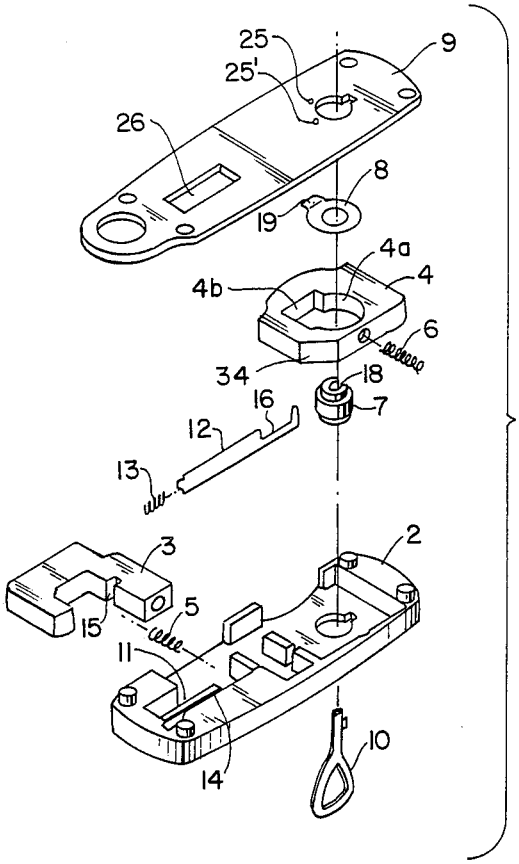
FIG. 10
FIG. 11
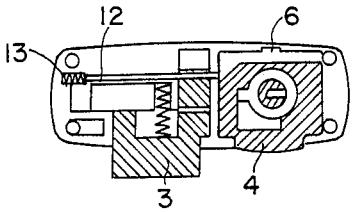
FIG. 12
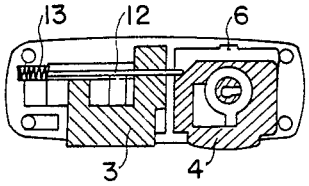

ZIPPER LOCK

BACKGROUND OF THE INVENTION

This invention in concerned with a zipper lock, and particularly locks disposed on a shift plate of a zipper lockable with other zipper knots and can be used in suitcases or luggage.

A conventional locking means for suitcases or luggage uses a slot on a shift plate of a zipper which engages with a zipper knot of the other corresponding zipper and is locked by a separate padlock. Yet for locking and opening a separate lock and key must be used. Thus, the use is inconvenient and the manufacturing cost is high. In addition, to carry a separate lock and key is always troublesome and easy to lose.

OBJECTS AND SUMMARY OF THE INVENTION

The object of the invention is to provide a lock disposed on a zipper and used in suitcases or luggage which eliminates the need to carry a separate lock.

Another object of the invention is to provide a lock convenient to use and which is cheap in its manufacturing cost.

Other and further objects, features and advantages of the invention will appear more fully from the following description.

BRIEF DESCRIPTION OF THE FIGURES

FIG. 6 is a perspective view of the second embodiment of the zipper lock in accordance with the invention;

FIG. 7 is an upside-down exploded view of the zipper lock according to FIG. 6;

FIG. 8 is a cross-sectional view of the lock in open position according to FIG. 6;

FIG. 9 is a cross-sectional view of the lock in locked position according to FIG. 6;

FIG. 10 is an upside-down exploded view of the third embodiment of the zipper lock according to the invention;

FIG. 11 is a cross-sectional view of the lock in open position according to FIG. 10; and FIG. 12 is a cross-sectional view of the lock in locked position according to FIG. 10.

Figure 1:
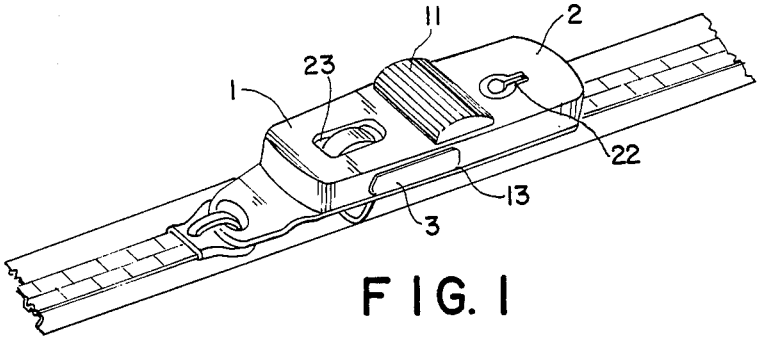
FIG. 1 is a perspective view of the first embodiment of the zipper lock in accordance with the invention.

DETAILED DESCRIPTION OF THE PREFERRED EMBODIMENTS;

In FIG. 1, a zipper lock 1 of the first embodiment of the invention comprises a casing 2 mounted on a base plate 9 which is a zipper shift plate with one end hooked to the zipper. On the face plate of casing 2, there is provided key hole 22, slots 21, 21 and ward slot 13. If necessary, a hole 23 may also be provided.

Figure 2:
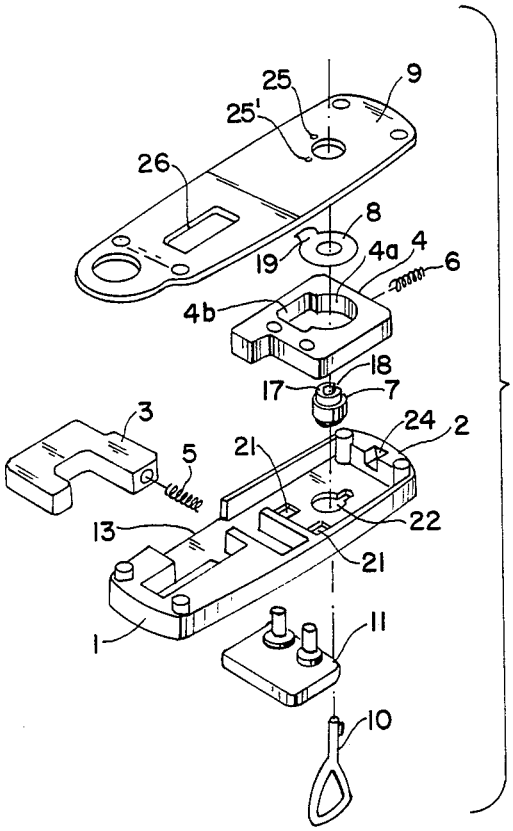
FIG. 2 is an upside-down exploded view of the zipper lock according to FIG. 1.
Figure 3:
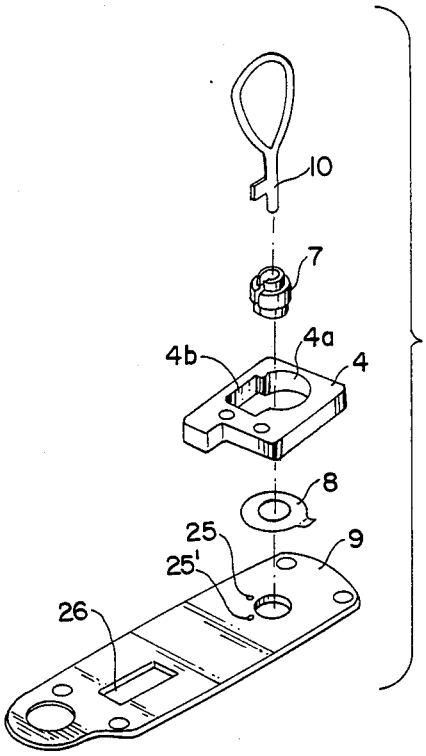
FIG. 3 is an exploded view of the locking elements according to FIG. 1.

Lock stand 4 as shown in FIG. 2 has a hollow P shape with a spring hole (not shown) in its upper side surface to receive a spring 6 to rest against the recess 24 disposed on one inner side wall of casing 2. Lock stand 4 is provided with a substantially central opening **4*a* and a contiguous limiting opening 4*b*. A sliding plate 3 has the shape of the numeral 7 with one of its arms provided with a recess shoulder and a hole on its side wall to receive a spring 5 to resist against the inner long side wall of casing 2. The central opening 4*a* of lock stand 4 can receive a cylindrical lock shaft 7 which possesses a retracted shoulder 17 on its upper and lower ends and a key slot 18. A lock pin 8 is a hollow plate with one end extended, and fits within central opening 4*a*. On the surface of the extended end of lock pin 8, protrusion 19 is provided and corresponds in position to the recesses 25', 25 provided on seat plate 9 (FIG. 3), and is positioned within limiting opening 4*b*. The length of the long end of lock pin 8 equals the longitudinal and transverse inner length of the hollow portion of lock stand 4. Thereby, when lock pin 8 is seated over the shoulder of shaft 7, it may be rotatable by a key 10 by 90 degrees from recess 25 to 25'** and back.

Figure 4:
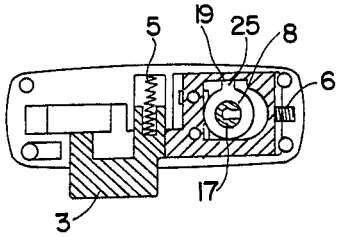
FIG. 4 is a cross-sectional view of the lock in open position according to FIG. 1.

The assembled state of the lock is as shown in FIG. 4 in which sliding plate 3 and stand 4 are mounted within casing 2 and a slide block 11 is integrated with lock stand 4. Thereby, movement of slide block 11 enables corresponding movement of lock stand 4. When the zipper lock of the invention is to be closed, another zipper knot is placed onto slot 26 and sliding plate 3 is pushed from the outside of casing 2 into its side wall. Thus, the knot is hooked by one arm of sliding plate 3 and the protruded portion of stand 4 will fall in the recess shoulder of sliding plate 3, thus closing zipper lock due to the spring force of spring 6.

In order to open the lock, the slide block 11 can be moved backward and the protrusion portion of stand 4 will leave the recess shoulder of sliding plate 3. The spring force of spring 5 will pop the sliding plate 3 outward from casing 2 and thus, the zipper knot can be taken out from slot 26.

Figure 5:
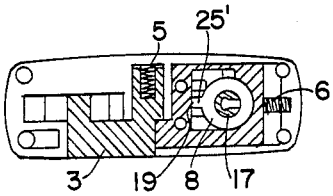
FIG. 5 is a cross-sectional view of the lock in locked position according to FIG. 1.

In order to lock the zipper lock of the present invention, the lock must first be in its closed state and a key 10 is used to turn the protrusion 19 of pin 8, 90 degrees from the recess 25 to recess 25' (as shown in FIG. 5), and thereby ward 4 can not be moved in the longitudinal direction of lock seat 9 and slide block 11 cannot be moved as well. In turn sliding plate 3 cannot spring out from casing 2, and is thus in a locked state.

The opening of the lock can be operated in the reverse direction as its locked state.

The second embodiment of the present invention is shown in FIGS. 6–9, where the lock stand and slide block are integrated as 4' with two wings exposed outside the longitudinal side wall of casing 2. All the other mechanisms and functions are identical to the first embodiment of the present invention. Thus, the opening and closing of the lock can be effected by moving the two wings of the lock stand exposed outside the casing.

FIGS. 10–12 represent the third embodiment of the zipper lock in accordance with the present invention. Lock stand 4 has an oblique cutting surface 34 in one of its corners. Sliding plate 3 has two legs with the longer leg having a slot 15 corresponding to the recess 16 provided on a slide plate 12. Slide plate 12 is pushed by a spring 13 at its protruded end. The other end of slide plate 12 contacts the oblique surface 34 when sliding plate 3 is pushed inside the casing 2. All the other elements are similar to those provided in the first and second embodiments.

When sliding plate 3 is pushed inside the casing, slide plate 12 will be pushed forward to rest against the oblique surface 34 of lock stand 4. When the shaft is turned 90 degrees by a separate key, lock stand 4 will be impossible to move out from the casing and is thus in a locked position. When the shaft is turned back to its normal position, pushing of the lock stand from the outside of the casing will push the slide plate left forward and release the slot from sliding plate 3, thus making sliding plate 3 pop out by means of the spring. That is, the lock will return to its open position.

It is to be understood that the form of the invention shown herein and described is to be taken as preferred examples of the same and that various changes and modifications may be made without departing from the scope of the invention.

I claim:

1. A zipper lock disposed on a shift plate of a zipper, comprising:

a longitudinal box shaped casing;

a lock stand slidably mounted in said casing and having a substantially P shape with a substantially central opening and a contiguous limiting opening;

a sliding plate slidably mounted in said casing and having a substantially 7 shape with one arm thereof forming a recess shoulder;

spring means for pushing said lock stand and said sliding plate against an inside wall of said casing;

a cylindrical lock shaft positioned within said substantially central opening of said lock stand and having a key slot and a retracted shoulder on an upper end thereof which is rotatable upon insertion and rotation of a key in said key slot;

a seat plate corresponding to a zipper sliding plate and having a hole for receiving a zipper knot, a lock shaft hole for receiving the key, and at least one recess hole adjacent the lock shaft hole; and a lock pin plate mounted on said retracted shoulder within said substantially central opening for rotation therewith, said lock pin plate including protrusion means positioned within said contiguous limiting opening for limiting rotation of said lock pin plate and for selectively engaging with said at least one recess hole to prevent movement of said lock stand in response to rotation of said retracted shoulder by the key;

said lock stand providing a resisting force against said sliding plate, so that when the lock stand is moved longitudinally and an extended arm thereof leaves the recess shoulder of said sliding plate, said sliding plate will spring out from said casing, thus providing the zipper lock in an open position and when the zipper lock is in a closed position, said protrusion means of said lock pin plate can be moved to said at least one recess hold in said seat plate to thereby make said lock stand immovable in the longitudinal direction of the zipper lock and thereby providing the lock in a locked position.

2. A zipper lock according to claim 1 wherein said lock stand is integrated with moving means as a two wings lock stand so that said lock stand can be movable by wings thereof.

3. A zipper lock disposed on a shift plate of a zipper, comprising:

a longitudinal box shaped casing;

a hollow lock stand slidably mounted in said casing and having a substantially central opening, a contiguous limiting opening and a corner provided with an oblique cutting surface;

a sliding plate slidably mounted in said casing and having two legs, one leg being longer and provided with a slot;

a slide plate provided with a recess corresponding to that of the slot provided on said sliding plate;

spring means for pushing said lock stand, sliding plate and slide plate against an inside wall of said casing;

a cylindrical lock shaft having a key slot and a retracted shoulder on an upper end thereof, which is rotatable upon insertion and rotation of a key in said key slot;

a seat plate corresponding to a zipper sliding plate and having a hole for receiving a zipper knot, a lock shaft hole for receiving the key, and at least one recess hole adjacent the lock shaft hole; and a lock pin plate mounted on said retracted shoulder within said substantially central opening for rotation therewith, said lock pin plate including protrusion means positioned within said contiguous limiting opening for limiting rotation of said lock pin plate and for selectively engaging with said at least one recess hole to prevent movement of said lock stand in response to rotation of said retracted shoulder by the key;

said lock stand providing a resisting force against said sliding plate through said slide plate so that when said lock stand is pushed by moving means in its longitudinal direction, so as to push said slide plate to release the slot from said sliding plate, the sliding plate is pushed inside the casing, the slide plate pushes forward to rest against the oblique surface of said lock stand, and when said shaft is turned so that the protrusion provided on said lock pin plate is moved to engage said at least one recess hole, said lock stand is made immovable in the longitudinal direction of the lock, thus providing the zipper lock in a locked position.

* * * * *